United States Patent [19]

Hawkinson et al.

[11] Patent Number: 4,901,869

[45] Date of Patent: Feb. 20, 1990

[54] MERCHANDISE DISPLAY RACK OF VARIABLE SIZE

[76] Inventors: Rodney B. Hawkinson, 1919 Valencia St., Napa, Calif. 94558; Julius A. Sarto, 383 N. Autumn St., San Jose, Calif. 95110

[21] Appl. No.: 236,742

[22] Filed: Aug. 26, 1988

[51] Int. Cl.[4] ..... A47F 7/00

[52] U.S. Cl. ..... 211/59.3; 211/184

[58] Field of Search ..... 211/59.3, 43, 184, 11, 211/94.5; 108/60, 61; 160/135; 312/71

[56] References Cited

U.S. PATENT DOCUMENTS

| | | | |
|---|---|---|---|
| 2,111,496 | 3/1938 | Sariba | 211/59.3 |
| 2,652,154 | 9/1953 | Stevens | 211/59.3 |
| 3,083,067 | 3/1963 | Vos et al. | 211/59.3 X |
| 3,308,961 | 3/1967 | Chesley | 211/59.3 |
| 4,730,741 | 3/1988 | Jackle, III et al. | 211/59.3 |

*Primary Examiner*—Ramon S. Britts
*Assistant Examiner*—Sarah A. Lechok
*Attorney, Agent, or Firm*—Melvin R. Stidham

[57] ABSTRACT

A merchandise display rack comprises a series of chutes that may be connected side by side or stacked. Each chute has a central slideway with a push plate slide, which is pulled forward by an elongated spring. Horizontal, lateral extension panels having parallel back to back V-grooves across the width thereof may readily be broken off along straight lines to selected widths and interlocked to the sides of the slideway. A longitudinal connector member interlocks with the lateral extension panels and vertical side panels to form the chute.

9 Claims, 2 Drawing Sheets

MERCHANDISE DISPLAY RACK OF VARIABLE SIZE

BACKGROUND OF THE INVENTION

This invention relates to a merchandise display rack, which is operative to feed a row of merchandise forwardly on a store shelf as items at the front of the shelf are removed. A display rack capable of moving a single row of merchandise is shown in our previous U.S. Pat. No. 4,729,481, granted Mar. 8, 1988 for "Apparatus For Advancing Shelved Goods."

Another single column feeding display rack is shown in Taylor U.S. Pat. No. 4,351,439, granted Sept. 28, 1982, and a display rack for feeding several rows of like items side by side in single tier fashion is shown in Stevens U.S. Pat. No. 2,652,154, granted Sept. 15, 1953.

OBJECTS OF THE INVENTION

It is an object of this invention to provide merchandise display racks that can be assembled in multiple tiers and rows.

It is a further object of this invention to provide a merchandise display rack, which can be made of selected widths and heights to accommodate different merchandise.

It is a further object of this invention to provide a merchandise display rack with a central pusher slideway to which may be attached lateral extension panels of selected widths.

It is a further object of this invention to provides extension panels and vertical side walls for a slideway which may readily be broken off along straight lines to selected widths and heights.

Other objects and advantages of this invention will become apparent from the description to follow, particularly when read in conjunction with the accompanying drawings.

SUMMARY OF THE INVENTION

In carrying out this invention, I provide a central slideway with a push plate slide to move a row of articles of merchandise forwardly as the front article is removed by a customer. The slideway has slots along the side into which lateral extension panels, which are broken off to selected widths, may be interlocked. Connector members may be applied to the side edge of the extension panels to enable vertical walls to be extended upwardly or downwardly and additional horizontal extension panels and slideways added laterally.

DESCRIPTION OF A PREFERRED EMBODIMENT

Figure 2:
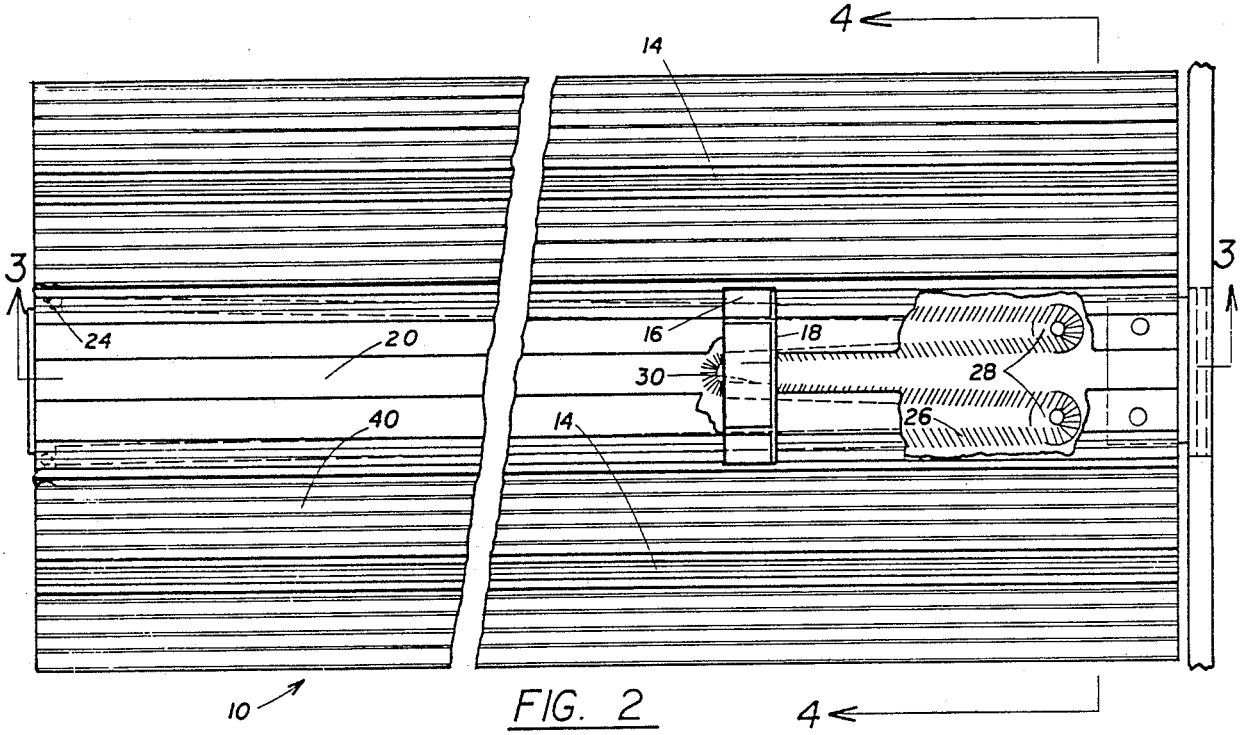
FIG. 2 is a plan view, partially broken away, of the display rack.

Referring now to the drawings with greater detail, the merchandise display rack 10 of this invention comprises a series of chutes 12 with side walls 14 to separate rows of merchandise in containers (not shown). As indicated, the chutes 12 may be assembled in stacked formation, as well as side by side. The driving member for moving merchandise forward in each chute 12 is a slide 16 carrying an upright push plate 18. The push plate slide 16 moves along a slideway 20 to push merchandise forwardly along a pair of slide rails 22. Anchored at each end 24 to the rear end of the slideway 20 is an elongated coil spring 26 (FIGS. 2 and 3), which is carried around pulleys 28 at the front end of the slideway on each side thereof. The portion of the spring 26 intermediate the pulleys 28 is extended around behind a depending member 30 on the push plate slide 16 so that the slide is constantly being pulled forward to push against merchandise aligned in front of it.

A label panel 32 is carried in a front stop 34 that limits forward movement of the slide 16 and a fascia 36 may be applied to cover the front stop 34. The label panel 32 has a series of horizontal score lines 38 and 39 back to back, so that the panel may be broken off at a selected height, e.g. high enough to prevent goods from toppling over it but low enough to facilitate removal of the goods as desired.

Lateral, horizontal slideway extension panels 40, each of which has a plurality of parallel, land strip 41 separated by V-grooves 42 and 44 arranged back to back in top and bottom are received in extender slots 46 along the sides of the slideway 20. Sharp interlock lips 48, referred to herein as first lips which are carried along the outter edges of each of the extender slots 46 are received in the V-grooves 42 and 44 in the extension panel 40 to lock it in place.

Figure 1:
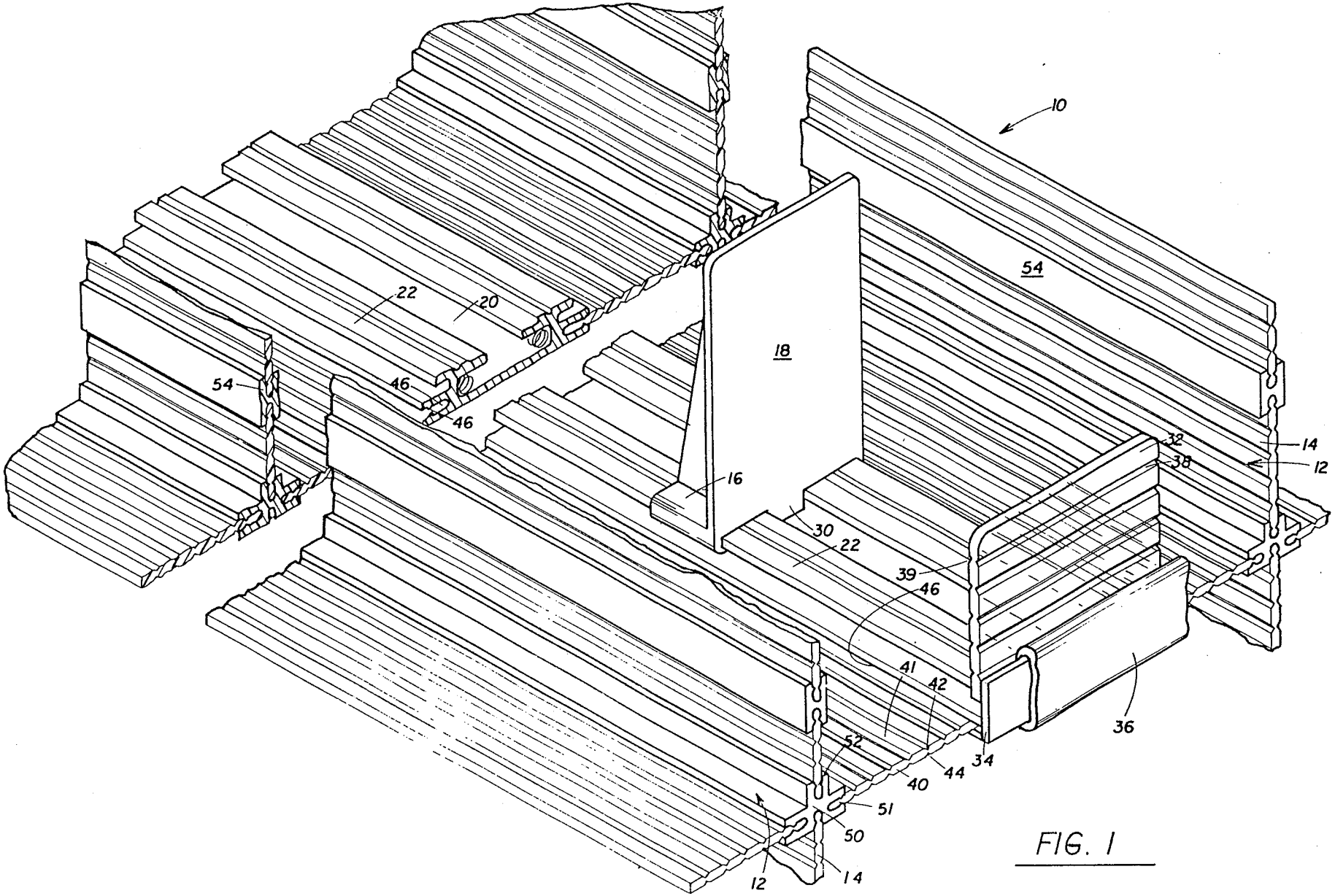
FIG. 1 is a view in perspective showing a display rack embodying features of this invention.
Figure 3:
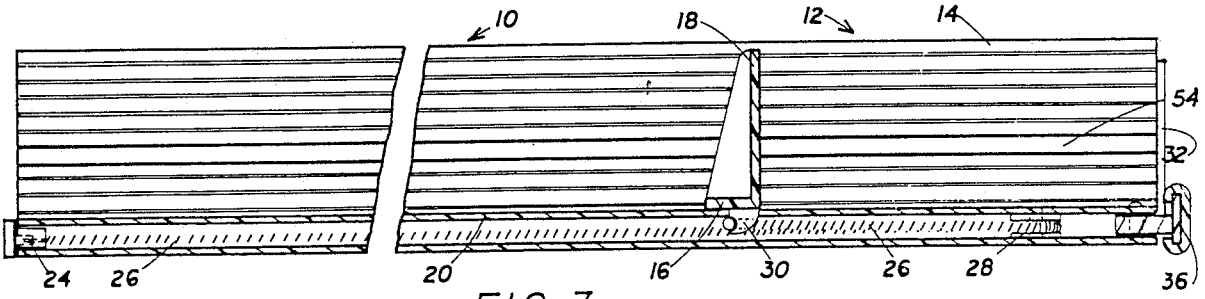
FIG. 3 is a section view taken along line 3—3 of FIG. 2.
Figure 4:
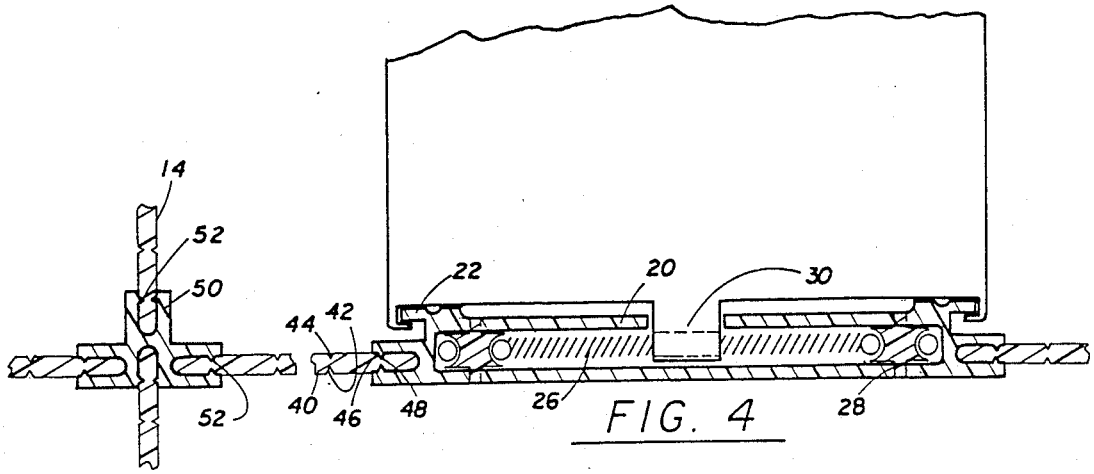
FIG. 4 is a section view taken along line 4—4 of FIG. 2.

Each extension panel 40 is readily broken off along a selected pair of back to back V-grooves 42 and 44 from the panel 40 of a selected width, depending on the merchandise being transported, and an elongated connector member 50 is snapped over the outer edge of the horizontal extension panel 40 as that sharp lips 51 snap into the first pair of V-grooves 42 and 44. Then, an upright side panel 14 can be broken off along aligned V-grooves to a selected height and interlocked in the upwardly directed C-clamp 52 of the connector member 50 by means of second lips formed on the outer edges. Should there be a chute side panel 14 below, the connector member 50 is snapped over a land 42 thereon and, if there is a chute 12 to the side, the oppositely directed horizontal C-clamp 52 can be snapped over the land 41 of the lateral slideway extension panel 40.

Where it is desired to add panels 40 or 14 to increase width or height of a chute 12 extender joint 54 with oppositely directed C-clamps may be added as shown in FIGS. 1 and 3.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A forward-feeding display rack for merchandise in containers arranged in a row front to rear comprising:

a slideway;

a slide slidably mounted in said slideway;

an upright push plate carried on said slide;

a front stop at the front end of said slideway engageable by said push plate;

a tension member biasing said push plate toward said front end of the slideway;

an extender slot along each side of said slideway;

first lips along the outer edges of said extender slots;

a first lateral extension panel of selected width;

said first lateral extension panel having a plurality of parallel, land strips across the width thereof, including an inner land strip along one side edge of said lateral extension panel and an outer land strip along the opposite side edge;

said land strips being separated by grooves in both the top and the bottom surfaces of said extension panel;

said inner land strip of said first lateral extension panel being received in the extender slot on one side of said slideway with said first lips along the edges of said one extender slot being received in a pair of said grooves;

an elongated side connector member having four sides, each side forming a C-shaped receptacle with second lips along the outer edges thereof, said outer land strip of said first lateral extension panel being received in one of said horizontal C-shaped receptacle with said second lips along the edges of said receptacle being received in a pair of said grooves; and a vertical side plate received in an upright one of said C-shaped receptacle with said second lips along the edges of said receptacle being received in a pair of said grooves.

2. The merchandise display rack defined by claim 1 including:

a second lateral extension panel of selected width having a plurality of second land strips across the width thereof, including one side land strip along one side edge of said second lateral extension and a second side land strip along the opposite side edge of said second lateral extension;

said one land strip of said second lateral extension panel being received in the extender slot on the other side of said slideway, with said first lips along the edges of said other side extender slot being received in a pair of said grooves;

a second elongated side connector member having four sides, each side forming a C-shaped receptacle with second lips along the outer edges thereof, said second land strip of said second lateral extension panel being received in a horizontal C-shaped receptacle of said second side connector member with said second lips along the edge of said receptacle being received in a pair of said grooves; and a second vertical side plate received in an upright C-shaped receptacle with a second said lip on said upright receptacle being received in one of said grooves.

3. The merchandise display rack defined by claim 1 wherein said front stop comprises:

an upright panel; and means forming a series of horizontal lines of weakness across said stop panel so that said stop panel can be broken off to a selected height.

4. The merchandise display rack defined by claim 1 including:

slide tracks along the upper surface of said slideway to support merchandise slidably thereon.

5. The merchandise display rack defined by claim 1 including:

a third lateral extension of selected width having a plurality of parallel successive land strips and grooves across the width thereof, including a first land strip along one side edge of said third lateral extension and an other land strip along the opposite side edge of said third lateral extension;

said first land strip of said third lateral extension panel being received in an outwardly directed C-shaped receptacle of said side connector member with said second lips along the edge of said outwardly directed horizontal receptacle being received in a pair of said grooves.

6. The merchandise display rack defined by claim 5 including:

a second slideway;

a slideway slidably mounted in said second slideway and carrying an upright push plate;

a tension member biasing said second slide toward the front end of said second slideway;

an extender slot along each side of said second slideway;

the outer edge of said third lateral extension panel being received in the extender slot on one side of said second slideway.

7. The merchandise display rack defined by claim 1 wherein said tension member is an elongated stretchable member and including:

anchor means at the rear end of said slideway at each side thereof securing the ends of said tension member;

a pulley at the front end of said slideway on each side thereof;

said tension member extending forwardly from said anchor members and around said pulleys, with the intermediate portion thereof engaging behind said slide.

8. The merchandise display rack defined by claim 7 wherein:

said tension member is an elongated spring.

9. The merchandise display rack defined by claim 1 wherein:

said grooves in said extension panel are back to back to form frangible lines of weakness.

* * * * *